United States Patent [19]

Murphy

[11] 4,018,050

[45] Apr. 19, 1977

[54] COMPRESSED AIR-OPERATED MOTOR EMPLOYING DUAL LOBE CAMS

[75] Inventor: John R. Murphy, Smithville, Miss.

[73] Assignee: Coy F. Glenn, Sulligent, Ala. ; a part interest

[22] Filed: July 16, 1976

[21] Appl. No.: 705,940

[52] U.S. Cl. ..... 60/370; 60/371; 60/407; 60/412

[51] Int. Cl.[2] ..... F15B 11/06

[58] Field of Search ..... 60/407, 412, 483, 369, 60/370, 371, 374; 91/188, 194, 480, 495; 92/146, 147; 180/44 F

[56] References Cited

UNITED STATES PATENTS

| | | | |
|---|---|---|---|
| 2,115,556 | 4/1938 | Maniscalco | 91/188 X |
| 3,563,032 | 2/1971 | LaPointe | 60/412 X |
| 3,765,180 | 10/1973 | Brown | 60/370 |
| 3,885,387 | 5/1975 | Simington | 60/370 |

FOREIGN PATENTS OR APPLICATIONS

| | | | |
|---|---|---|---|
| 490,797 | 1/1919 | France | 60/412 |

OTHER PUBLICATIONS

Washington Evening Star Article of Oct. 20, 1931, & Washington Herald Articles of Oct. 22, 1931 & Nov. 2, 1931, relating to Air Motors for Automobiles, Meyers & Anania "Inventors."

*Primary Examiner*—Edgar W. Geoghegan
*Attorney, Agent, or Firm*—Browdy and Neimark

[57] ABSTRACT

An air-operated engine system usable for driving a vehicle by means of compressed air from a rechargeable storage tank. The engine of the system has cylinders containing driving pistons connected to a crankshaft. Compressed air from the storage tank is supplied at regulated pressure to the cylinders for power strokes by means of intake valves and the air is exhausted from the cylinders at the ends of the power strokes by means of exhaust valves. The intake and exhaust valves are operated by dual lobe cams on a camshaft driven from the crankshaft. The air is compressed by a hydrovane compressor which has a constant flow of air operating under 100 pounds pressure with control valves which will take in 25 pounds per minute up to 200 pounds. The output pressure is controlled by the input pressure.

10 Claims, 6 Drawing Figures

FIG. 1

COMPRESSED AIR-OPERATED MOTOR EMPLOYING DUAL LOBE CAMS

FIELD OF THE INVENTION

This invention relates to compressed air-operated engine systems, and more particularly to an improved compressed air-operated engine system for driving a motor vehicle.

BACKGROUND OF THE INVENTION

In the course of development of pollution-free driving systems for motor vehicles, various systems have been proposed for operating vehicles by means of piston engines driven by compressed air. These systems usually involve the use of a source of compressed air, such as a pressure tank, from which the working fluid is supplied to the engine cyclinders through suitable admission valves suitably timed to provide power strokes of the pistons, and on the return strokes the expanded air is allowed to discharge from the cylinders via suitably timed exhaust valves. The air is filtered by using a hydrovane compressor which has intake filters that remove pollution, making the exhausted air more purified than it was when it entered the compressor. This hydrovane system is a constant flow air compressor. It will put out 25 pounds pressure per minute up to 200 pounds per minute.

SUMMARY OF THE INVENTION

Accordingly, a main object of the invention is to provide a novel and improved compressed air-operated system for a motor vehicle, the system operating totally on compressed air so that it does not pollute the atmosphere, and having highly efficient valve-operating cam means to control the admission of compressed air to the cylinders for the power strokes and to control the release of the air after said power strokes.

A further object of the invention is to provide an improved compressed air-operated engine suitable for driving a motor vehicle, the engine being of the multiple-cylinder type and having properly timed dual-lobed cams for controlling the admission and exhaust of the air to and from the cylinders, and being very economical to operate.

A still further object of the invention is to provide an improved compressed air-operated multiple-cylinder engine suitable for driving a motor vehicle, the engine having a high degree of dynamic balance, being relatively compact in size, and utilizing a simple and efficient dual-lobe cam arrangement to control the admission of compressed air to cylinders wherein the pistons are positioned for power strokes and the exhaust from cylinders wherein the pistons have completed their power strokes.

BRIEF DESCRIPTION OF THE DRAWINGS

Further objects and advantages of the invention will become apparent from the following description and claims, and from the accompanying drawings, wherein:

DESCRIPTION OF PREFERRED EMBODIMENTS

Figure 1:
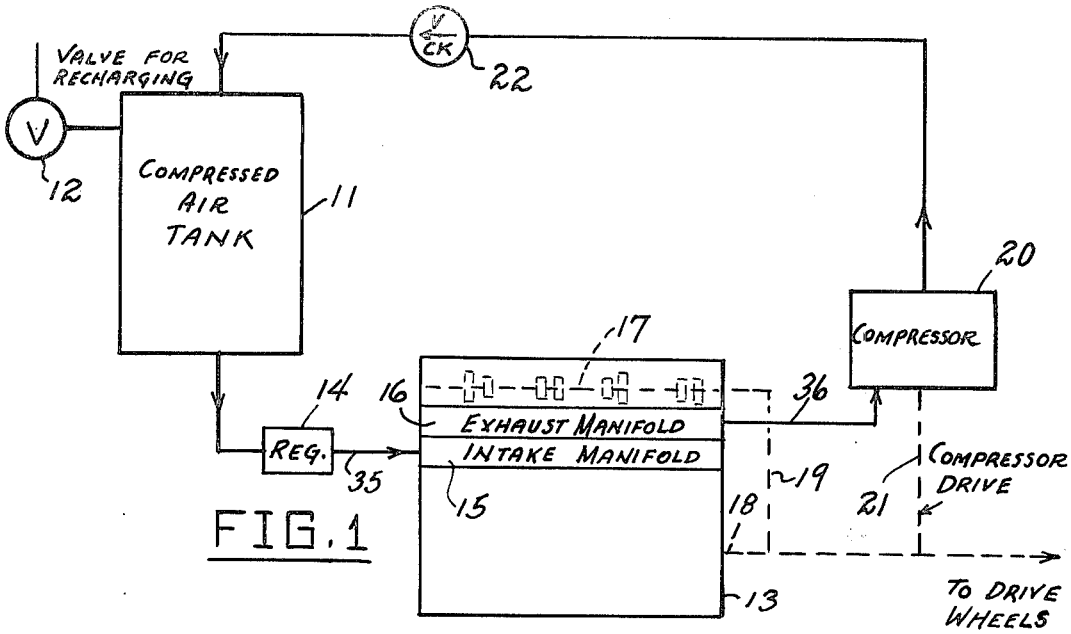
FIG. 1 is a schematic diagram of a typical improved compressed air-operated engine system for a motor vehicle, in accordance with the present invention.

Referring to the drawings, FIG. 1 schematically illustrates the fluid circuit of the engine system in a typical compressed air-driven motor vehicle according to the present invention. The fluid circuit comprises a compressed air storage tank 11 which is chargeable with compressed air from a suitable external source through a control valve 12. Tank 11 is connected to a compressed air-driven engine 13 through a conventional pressure regulator 14, whereby to furnish air at a suitable pressure to the intake manifold 15 of the engine. As will be presently described, the compressed air is supplied to the cylinders of the engine through timed air admission valves to provide power strokes of the engine pistons. At the ends of the power strokes the expanded air is exhausted from the cylinders to an exhaust manifold 16 through timed exhaust valves, the opening of the air admission valves and of the exhaust valves being suitably timed by the action of a camshaft assembly 17 driven by the crankshaft 18 through a positive-drive transmission assembly designated generally at 19. The engine 13 may be of a type wherein the valves are of the poppet type, directly operated by the camshaft assembly, as in FIG. 2, presently to be described, or of a type employing conventional rocker arms and push rods to couple the camshaft assembly to the valves, as in FIG. 5, also to be presently described.

The reduced-pressure air from the exhaust manifold 16 is recompressed in a compressor 20 driven by crankshaft 18 by conventional coupling means 21, and the recompressed air is returned to the storage tank 11 through a conventional check valve 22.

Crankshaft 18 is drivingly connected in a conventional manner through suitable clutch means and speed-changing means to the driving wheels of the associated vehicle.

Figure 2:
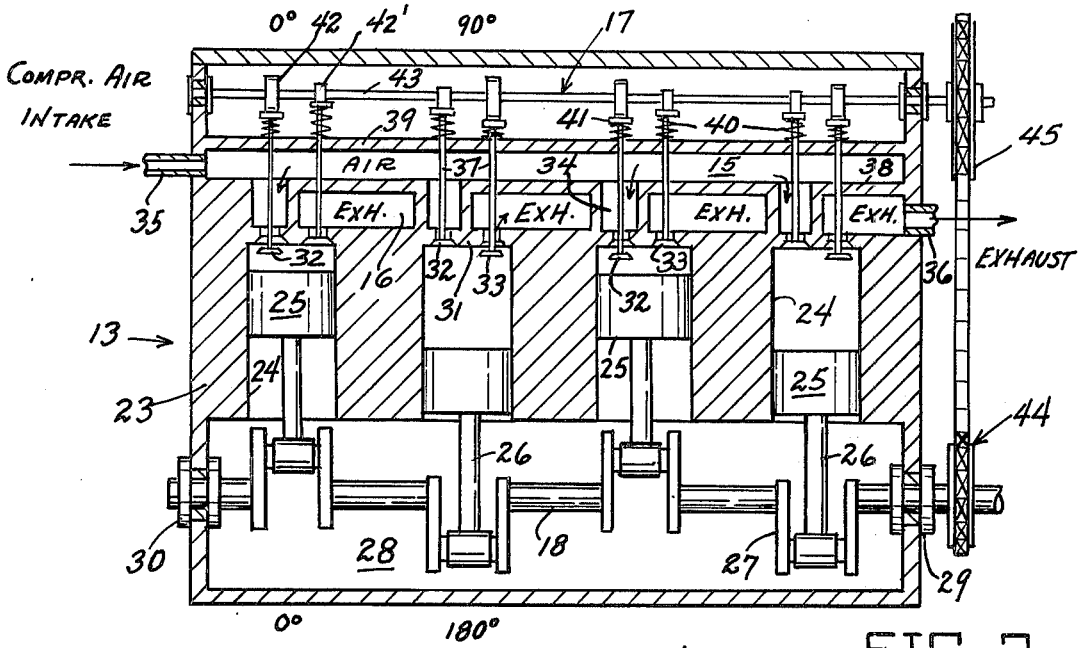
FIG. 2 is a longitudinal vertical cross-sectional view taken through a typical compressed air-operated engine which may be employed in the system of FIG. 1, the engine employing direct-operated admission and exhaust valves controlled by dual-lobed cams according to this invention.
Figure 3:
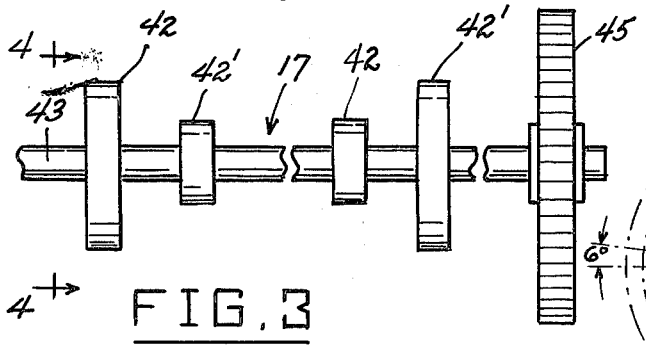
FIG. 3 is an enlarged fragmentary elevational view of the camshaft assembly employed in the typical engine of FIG. 2.
Figure 4:
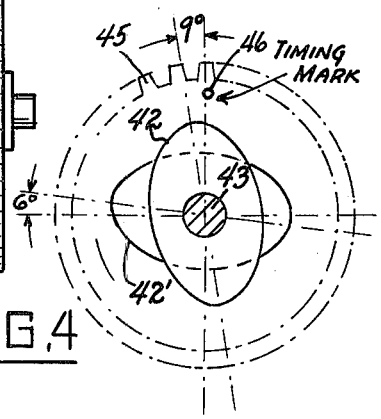
FIG. 4 is a vertical cross-sectional view taken substantially on line 4—4 of FIG. 3.

Referring to FIGS. 2, 3 and 4, the typical engine, shown at 13, comprises a block 23 formed with four longitudinally aligned cylinders 24 containing pistons 25 connected by connecting rods 26 to the respective crank elements 27 of the crankshaft 18, contained in a crankcase 28, the crankshaft being suitably journalled at 29, 30 in the end walls of the crankcase.

In the typical four-cylinder engine 13, the crank elements 27 are coplanar but alternate in their crank configurations. Thus, the first and third pistons 25 reach their uppermost positions in their cylinders 24 when the second and fourth pistons reach their lowermost positions, as shown in FIG. 2, and similarly, when the second and fourth pistons reach their uppermost positions, the first and third pistons reach their lowermost positions.

The cylinders have top walls 31 formed with valve ports containing compressed air admission valves 32 and air exhaust valves 33. The air admission ports communicate via conduits 34 with the air intake manifold 15, and the air exhaust ports communicate with the exhaust manifold 16. An air supply conduit 35 connects regulator 14 to intake manifold 15. An exhaust conduit 36 connects exhaust manifold 16 to the inlet of compressor 20.

The valves 32 and 33 have headed valve rods 37 slidably and sealingly engaging through the horizontal manifold walls 38, 39, and are biased upwardly toward closed positions by coiled springs 40 surrounding the valve rods and bearing between the poppet valve heads 41 and the horizontal manifold wall 29. The air admission and exhaust valve heads are respectively engaged by dual-lobed, generally oval cams 42, 42' rigidly secured on the supporting shaft 43 of camshaft assembly 17.

The camshaft 43 is positively driven by crankshaft 18 by a suitable driving coupling, for example, a chain drive assembly 44 having a camshaft gear 45, providing a 2:1 drive ratio, so that camshaft 43 rotates at one-half the speed of crankshaft 18. Thus, considering the first cylinder 24, its air admission valve 32 opens every 180° of rotation of camshaft 43, namely, at each revolution of crankshaft 18 as the associated piston 25 passes its uppermost position. The associated air admission cam 42 preferably has its maximum radius 9° behind the top dead center mark 46 on the camshaft driving gear 45, as shown in FIG. 4, so that compressed air admission occurs shortly after the piston 25 begins its descent from its top dead center position. Similarly, the air exhaust cam 42' associated with said first cylinder has its maximum radius 6° ahead of the camshaft position corresponding to bottom dead center of the associated piston 25, whereby the associated exhaust valve 33 opens slightly before the piston reaches its bottom dead center position.

In the arrangement illustrated in FIG. 2, the air admission valves 32 for the first and third cylinders open simultaneously, providing simultaneous power strokes by the first and third pistons; the exhaust valves 33 for the second and fourth cylinders open simultaneously, allowing the expanded air therein to be discharged simultaneouslyinto the exhaust manifold 16. The exhaust valves 33 for the second and fourth cylinders open before the opening of the compressed air admission valves 32 for the first and third cylinders, assuring that their power strokes will not be opposed by compression build-up in the second and fourth cylinders.

The above-described action reverses for every 180° of rotation of crankshaft 18 (every 90° of rotation of camshaft 43).

Delay in the opening of the air admission valves 32 until the pistons have passed top dead center assures that the pistons will have begun their descent at the times that the compressed air is admitted into the associated cylinders and will assure smoothness in the generation of the power strokes.

Figure 5:
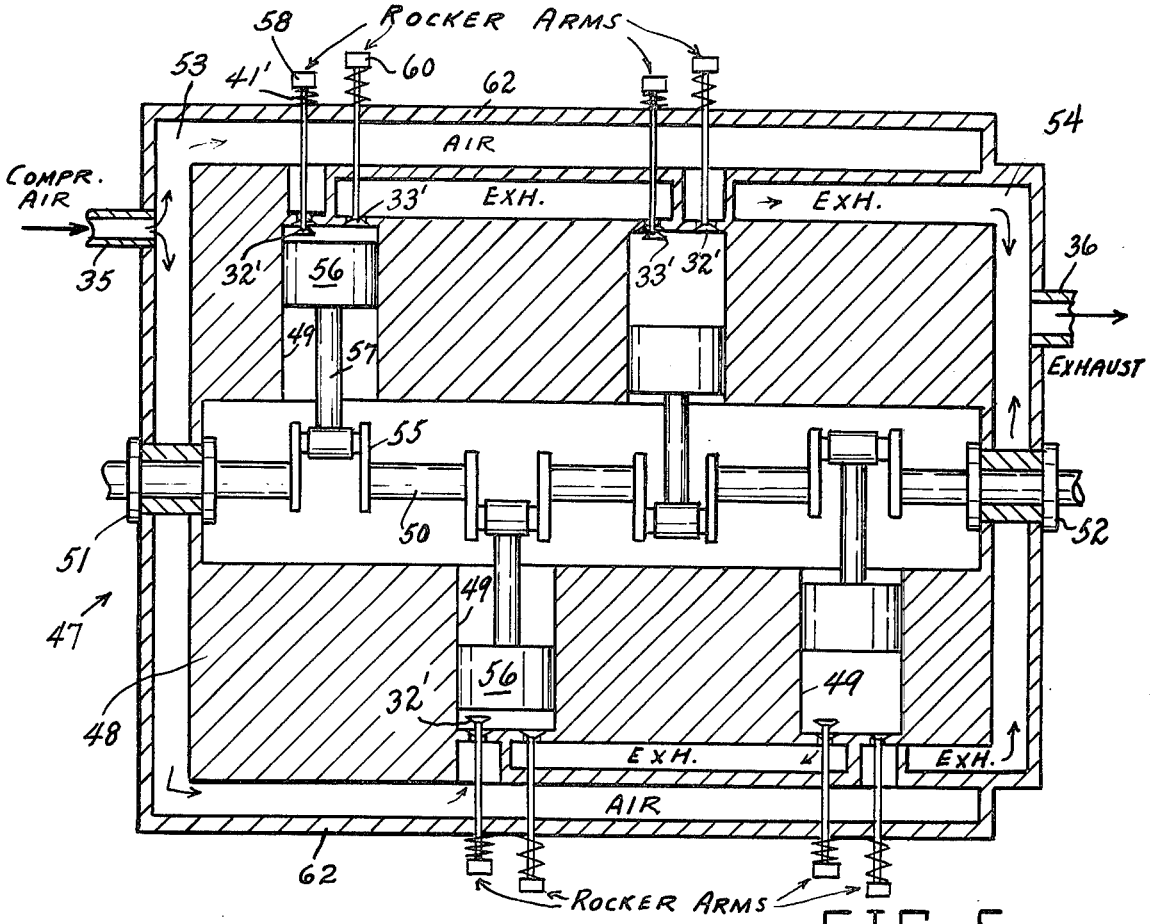
FIG. 5 is a horizontal cross-sectional view taken through another typical compressed air-operated engine according to the present invention, employing rocker arm-actuated air admission and exhaust valves controlled by dual-lobed cams according to the present invention, said cams controlling rocker arm push rods.
Figure 6:
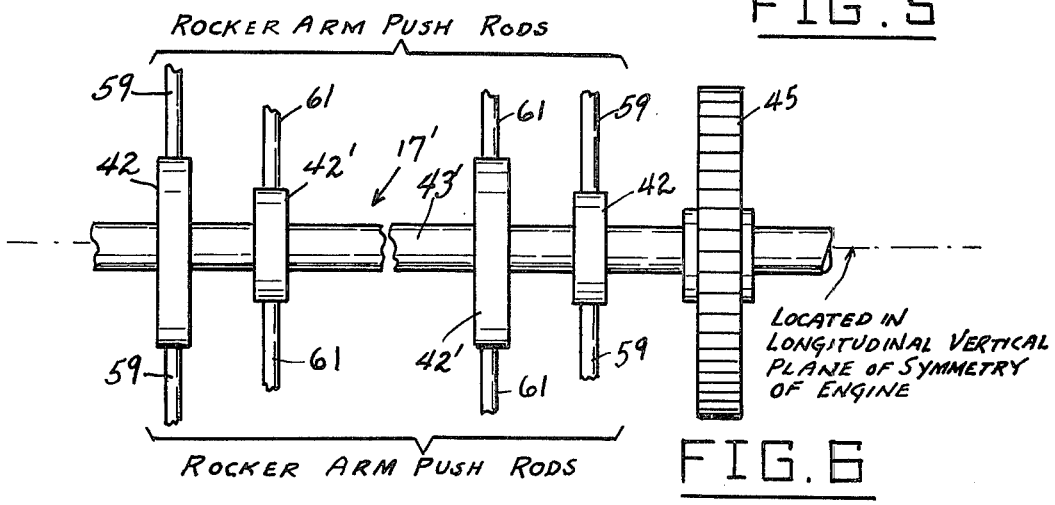
FIG. 6 is a fragmentary elevational view of the camshaft and associated rocker arm push rods employed with the engine of FIG. 5.

Referring now to FIGS. 5 and 6, 47 generally designates another typical engine according to the present invention, said engine comprising a block 48 formed with four cylinders 49, said cylinders being substantially horizontally coplanar and being arranged in staggered pairs on opposite sides of a crankshaft 50 suitably journalled at 51, 52 in opposite ends of the block 48. The block is formed with the compressed air intake manifold 53, and inwardly thereof, with the exhaust manifold 54. As shown, the compressed air intake conduit 35 is communicatively connected to intake manifold 53 and the exhaust conduit 36 is communicatively connected to the exhaust manifold 54.

The crankshaft has the respective crank elements 55 connected to pistons 56 in the cylinders 49 by connecting rods 57. The configuration of the crank elements 55 is such that the first and fourth crank elements are in phase, and the second and third crank elements are likewise in phase but are 180° from the first and fourth crank elements. Thus, as shown in FIG. 5, when the piston of the first cylinder is in its outermost position, the piston of the third cylinder, located on the same side of crankshaft 50, is in its innermost position, Similarly, at this time the piston in the second cylinder, at the opposite side of the crankshaft, is in its outermost position and the piston in the fourth cylinder, also at said opposite side, is in its innermost position. Rotation through 180° of crankshaft 50 retracts the first and second pistons to their innermost positions and extends the third and fourth pistons to their outermost positions.

The end walls of the cylinders are provided with valve ports communicating respectively with the intake manifold 53 and the exhuast manifold 54, and with respective air admission valves 32' and exhaust valves 33' cooperable with said ports. The air admission valves 32' have valve rods connected to rocker arms 58 operated by push rods 59 (see FIG. 6), and the exhaust valves 33' have valve rods connected to rocker arms 60 operated by push rods 61. A camshaft assembly 17' is journalled in the engine block 48 parallel to crankshaft 50 in a longitudinal vertical plane of symmetry relative to the pairs of cylinders on the opposite sides of the crankshaft, said camshaft assembly having the dual-lobed cams 42, 42' located between and being engaged by the inner ends of oppositely disposed pairs of push rods 59, 59 and 61, 61, as shown in FIG. 6. Coiled springs 41' surround the outer end portions of the valve rods and bear between the rocker arms and the outer air manifold walls 62, 62, biasing the valves toward closed positions.

The camshaft, shown at 43', is driven from the crankshaft 50 in the same manner as described in connection with the embodiment of FIGS. 2 to 4.

The first pair of dual-lobed cams 42, 42' simultaneously controls the air admission valves 32' and the exhaust valves 33' for the first and second cylinders 49, and the second pair of dual-lobed cams 42', 42 simultaneously controls the exhaust valves 33' and the air admission valves 32' of the third and fourth cylinders 49. The push rods 59, 59 for the first and second cylinders 49 simultaneously engage the opposite maximum-radius portions of the first dual-lobed cam 42 to simultaneously open the air admission valves 32', 32' for the first and second cylinders,to provide the power strokes of the associated pistons 56, 56. This occurs 9° of camshaft rotation after the outer dead center positions of the pistons, namely, as the pistons begin to move inwardly. The push rods 61, 61 for these clyinders engage the minimum radius portions of the adjacent dual-lobed cam 42' at this time and allow the exhaust valve 33' for these cylinders to remain closed. As the pistons approach their innermost dead center positions (6° of camshaft rotation ahead of piston inward dead center)

the push rods 61, 61 engage the opposite maximum-radius portions of said cam 42' and simultaneously open the exhaust valves 33', 33' of the first two cylinders, whereas their intake valves 32' are then closed. This allows the expanded air in the cylinders to be discharged into the exhaust manifold 54. At this time, the pistons of the third and fourth cylinders are approaching their outermost dead center positions. Shortly after passing said outermost dead center positions their associated push rods 59, 59 open their air admission valves 32' to generate power strokes of the third and fourth pistons.

As in the first-described embodiment, due to the advance opening of the exhaust valves 33' for the first and second cylinders, the power strokes developed by the pistons of the third and fourth cylinders will not be opposed by pressure build-up in the first and second cylinders, and similarly, power strokes developed in the first and second cylinders will not be opposed by pressure build-up in the third and fourth cylinders, because of the advance opening of the exhaust valves of said third and fourth cylinders as the pistons in the first and second cylinders approach their outer dead center positions.

The arrangement of FIG. 5 provides improved dynamic balance characteristics due to the substantially symmetrical locations of the first and third cylinders and the second and fourth cylinders with respect to the longitudinal vertical plane containing crankshaft axis. In this respect the configuration of FIG. 5 resembles that of a conventional Volkswagen Model 1300 internal combustion engine.

While certain specific embodiments of an improved compressed air-operated engine system employing dual-lobed cams have been disclosed in the foregoing description, it will be understood that various modifications within the spirit of the invention may occur to those skilled in the art. Therefore it is intended that no limitations be placed on the invention except as defined by the scope of the appended claims.

What is claimed is:

1. In an engine system for driving a vehicle, a compressed air storage tank, an engine provided with a plurality of cylinders containing pistons and a crankshaft having crank elements connected to said pistons, compressed air supply conduit means connecting said storage tank to the cylinders and including respective intake valves controlling admission of compressed air to the cylinders for generating power strokes, exhaust conduit means connected to the cylinders and including respective exhaust valves controlling discharge of expanded air from the cylinders, camshaft means drivingly coupled with the crankshaft, said camshaft means including a plurality of dual-lobed cams, and respective follower means engaging said cams and being operatively coupled to said intake and exhaust valves, said cams and follower means being arranged to open the intake valves shortly after the pistons pass their extended dead center positions in the cylinders to generate the power strokes, and to open the exhaust valves shortly before the pistons reach their retracted dead center positions in the cylinders at the ends of said power strokes.

2. The engine system of claim 1, and means including an air compressor communicatively connecting said exhaust conduit means to said storage tank.

3. The engine system of claim 1, and wherein said compressed air supply conduit means includes a pressure regulator.

4. The engine system of claim 1, and wherein the cylinders have end walls, each cylinder having an intake valve and an exhaust valve in its end wall, and wherein the respective dual-lobed cams for operating the intake valve and exhaust valve are spaced longitudinally on said camshaft means with substantially the same spacing as said valves.

5. The engine system of claim 1, and wherein the dual-lobed cams are each arranged to simultaneously open two valves.

6. The engine system of claim 1, and wherein the dual-lobed cams are of generally oval shape having opposed maximum-radius portions and the follower means includes two opposing substantially aligned rod elements engaging each cam, said opposing rod elements being operatively connected to the corresponding valves of a pair of cylinders, there being two dual-lobed cams for each pair of cylinders, one set of opposing rod elements being operatively connected to the intake valves of said pair of cylinders and the other set of opposing rod elements being operatively connected to the exhaust valves of said pair of cylinders.

7. The engine system of claim 6, and wherein the intake valve-operating cam has its major axis approximately 9° behind the extendedpiston dead center position of said camshaft means, and wherein the exhaust valve-operating cam has its major axis approximately 6° ahead of the retracted-piston dead center position of said camshaft means.

8. The engine system of claim 7, and wherein the pair of cylinders are substantially coplanar and the cylinders of said pair are located substantially symmetrically on opposite sides of said crankshaft.

9. The engine system of claim 8, and wherein said crankshaft has crank elements arranged to bring one pair of pistons simultaneously to extended dead center positions while another pair of pistons are brought simultaneously to retracted dead center positions.

10. The engine system of claim 9, and wherein the cylinders of the engine are substantially coplanar and are arranged substantially in a horizontal plane.

* * * * *